US011741887B2

(12) United States Patent
Kim et al.

(10) Patent No.: US 11,741,887 B2
(45) Date of Patent: Aug. 29, 2023

(54) PIXEL AND DISPLAY DEVICE HAVING A FRAME FREQUENCY WITH A PLURALITY OF NON-EMISSION PERIODS

(71) Applicant: SAMSUNG DISPLAY CO., LTD., Yongin-si (KR)

(72) Inventors: Yong Jae Kim, Yongin-si (KR); Yun Hwan Park, Yongin-si (KR); Woo Ri Seo, Yongin-si (KR); Yoon Jee Shin, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/745,179

(22) Filed: May 16, 2022

(65) Prior Publication Data

US 2023/0036497 A1 Feb. 2, 2023

(30) Foreign Application Priority Data

Aug. 2, 2021 (KR) ..... 10-2021-0101599

(51) Int. Cl.
*G09G 3/32* (2016.01)

(52) U.S. Cl.
CPC ..... *G09G 3/32* (2013.01); *G09G 2300/0842* (2013.01); *G09G 2310/0278* (2013.01)

(58) Field of Classification Search
CPC ..... G09G 3/32
USPC ..... 345/55
See application file for complete search history.

(56) References Cited

U.S. PATENT DOCUMENTS

| | | | | |
|---|---|---|---|---|
| 7,063,429 | B2 | 6/2006 | Hirano et al. | |
| 10,109,237 | B2 | 10/2018 | Park et al. | |
| 10,510,301 | B2 | 12/2019 | Na et al. | |
| 10,909,923 | B2 | 2/2021 | Kim et al. | |
| 2007/0040770 | A1* | 2/2007 | Kim | G09G 3/3291 345/76 |
| 2018/0122301 | A1* | 5/2018 | Yoon | G09G 3/3258 |
| 2020/0357337 | A1* | 11/2020 | Kim | G09G 3/3275 |

FOREIGN PATENT DOCUMENTS

| | | | |
|---|---|---|---|
| KR | 100500187 | B1 | 7/2005 |
| KR | 1020170102131 | A | 9/2017 |
| KR | 1020170105683 | A | 9/2017 |
| KR | 101907959 | B1 | 12/2018 |
| KR | 1020200129242 | A | 11/2020 |

* cited by examiner

*Primary Examiner* — Long D Pham
(74) *Attorney, Agent, or Firm* — CANTOR COLBURN LLP

(57) ABSTRACT

A display device includes a pixel, a scan driver supplying first to third scan signals in a first non-emission period and supplying the second scan signal in a second non-emission period, an emission driver supplying an emission control signal in the first and second non-emission periods, and a data driver supplying a data signal in the first non-emission period. The pixel includes a light-emitting element, a first transistor, a second transistor connected between the data line and a second node, a first capacitor connected between the first and second nodes, a third transistor connected between a third power line and the first node, a storage capacitor connected between the first and third nodes, a fourth transistor connected between the third node and a fourth power line, a fifth transistor connected between the first power line and the first transistor, and a sixth transistor supplying a fifth supply voltage.

18 Claims, 9 Drawing Sheets

PIXEL AND DISPLAY DEVICE HAVING A FRAME FREQUENCY WITH A PLURALITY OF NON-EMISSION PERIODS

The application claims priority to Korean patent application No. 10-2021-0101599, filed on Aug. 2, 2021, and all the benefits accruing therefrom under 35 U.S.C. § 119, the content of which in its entirety is herein incorporated by reference.

BACKGROUND

1. Field

Various embodiments of the invention relate to a display device, and more particularly to a pixel to which variable frequency driving is applied and a display device including the pixel.

2. Description of the Related Art

A display device may include a plurality of pixels. Each of the pixels may include a plurality of transistors, a light-emitting element electrically connected to the transistors, and a capacitor. The transistors may generate a driving current based on signals provided through signal lines, and the light-emitting element may emit light based on the driving current.

To enhance a driving efficiency of the display device, it is desired to reduce power consumption of the display device. The power consumption of the display device may be reduced by reducing a driving frequency (or data writing frequency) when a static image is displayed, for example. Further, in order to display an image under various conditions, the display device may display images at various frame frequencies (or driving frequencies).

SUMMARY

Embodiments of the invention provide a pixel that provides a data signal to a first transistor based on a capacitance ratio of a first capacitor and a storage capacitor.

Furthermore, embodiments of the invention provide a display device including the pixel.

However, features of the invention are not limited to the above-described objects, and various modifications are possible without departing from the spirit and scope of the invention.

An embodiment of the invention may provide a display device including a pixel connected to a first scan line, a second scan line, a third scan line, an emission control line, and a data line, a scan driver which supplies a first scan signal, a second scan signal, and a third scan signal to the first scan line, the second scan line, and the third scan line, respectively, in a first non-emission period, and supplies the second scan signal to the second scan line in a second non-emission period, an emission driver which supplies an emission control signal to the emission control line in the first non-emission period and the second non-emission period, and a data driver which supplies a data signal to the data line in the first non-emission period.

The pixel may include a light-emitting element, a first transistor which controls a driving current flowing from a first power line providing a first supply voltage through the light-emitting element to a second power line providing a second supply voltage based on a voltage of a first node, a second transistor which is connected between the data line and a second node, and turned on in response to the first scan signal supplied to the first scan line, a first capacitor connected between the first node and the second node, a third transistor which is connected between a third power line providing a third supply voltage and the first node, and turned on in response to the third scan signal supplied to the third scan line, a storage capacitor connected between the first node and a third node, a fourth transistor which is connected between the third node and a fourth power line providing a fourth supply voltage, and turned on in response to the second scan signal supplied to the second scan line, a fifth transistor which is connected between the first power line and the first transistor, and turned off in response to the emission control signal supplied to the emission control line, and a sixth transistor which supplies a fifth supply voltage to the second node in response to the third scan signal.

In an embodiment, the first transistor may include a first electrode connected to the fifth transistor, a second electrode electrically connected to the third node, a first gate electrode connected to the first node, and a second gate electrode connected to the second electrode.

In an embodiment, the sixth transistor may be connected between the third power line and the second node, and the fifth supply voltage may be the third supply voltage.

In an embodiment, at least one of the second to sixth transistors may include an oxide semiconductor pattern, a first gate electrode which overlaps the oxide semiconductor pattern, and a second gate electrode facing the first gate electrode with the oxide semiconductor pattern interposed therebetween, and electrically connected to the first gate electrode.

In an embodiment, the first non-emission period may include a first period, a second period, a third period, and a fourth period which are sequentially performed, and the second scan signal and the third scan signal may be supplied to the second scan line and the third scan line, respectively, during the first period.

In an embodiment, during the second period, the third scan signal may be supplied to the third scan line, and the fifth transistor may be turned on by interruption of the emission control signal.

In an embodiment, the first scan signal and the second scan signal may be supplied to the first scan line and the second scan line, respectively, during the third period, and the data signal may be supplied to the pixel in response to the first scan signal.

In an embodiment, the second scan signal may be supplied to the second scan line during the fourth period.

In an embodiment, the sixth transistor may be connected between the fifth power line and the second node, and the fifth supply voltage may be different from the third supply voltage.

In an embodiment, the sixth transistor may be connected between the first node and the second node, and the fifth supply voltage may be identical to as the third supply voltage.

In an embodiment, the scan driver may supply a fourth scan signal to the pixel through a fourth scan line in the first non-emission period and the second non-emission period.

In an embodiment, the pixel may further include a seventh transistor which is connected between a fifth power line providing a sixth supply voltage and the second electrode of the first transistor, and turned on in response to the fourth scan signal, and an eighth transistor which is connected between the second electrode of the first transistor and the third node, and turned off in response to the emission control signal.

In an embodiment, the scan driver may supply the fourth scan signal to the fourth scan line in the fourth period.

In an embodiment, the fourth scan signal may overlap at least a part of the third period.

In an embodiment, capacitance of the storage capacitor may be greater than capacitance of the first capacitor.

An embodiment of the invention may provide a pixel connected to first to fifth power lines, first to third scan lines, a data line and an emission control line and including a light-emitting element, a first transistor which controls a driving current flowing from the first power line providing a first supply voltage through the light-emitting element to the second power line providing a second supply voltage based on a voltage of a first node, a second transistor which is connected between the data line and a second node, and turned on in response to a first scan signal supplied to the first scan line, a first capacitor connected between the first node and the second node, a third transistor which is connected between the third power line providing a third supply voltage and the first node, and turned on in response to a third scan signal supplied to the third scan line, a storage capacitor connected between the first node and a third node, a fourth transistor which is connected between the third node and the fourth power line providing a fourth supply voltage, and turned on in response to a second scan signal supplied to the second scan line, a fifth transistor which is connected between the first power line and the first transistor, and turned off in response to an emission control signal supplied to the emission control line, and a sixth transistor connected between the fifth power line providing a fifth supply voltage and the second node.

In an embodiment, the first transistor may include a first electrode connected to the fifth transistor, a second electrode electrically connected to the third node, a first gate electrode connected to the first node, and a second gate electrode connected to the second electrode, and capacitance of the storage capacitor may be greater than capacitance of the first capacitor.

In an embodiment, one frame period may include a first non-emission period and at least one second non-emission period, the first non-emission period may include a first period, a second period, a third period, and a fourth period which are sequentially performed, and the third transistor, the fourth transistor, and the sixth transistor may be turned on during the first period.

In an embodiment, during the second period, the third transistor, the fifth transistor, and the sixth transistor may be turned on, and a threshold voltage of the first transistor may be stored in the storage capacitor.

In an embodiment, during the third period, the second transistor and the fourth transistor may be turned on, and a data signal may be written, and the fourth transistor may be turned on during the fourth period.

BRIEF DESCRIPTION OF THE DRAWINGS

The above and other exemplary embodiments, advantages and features of this disclosure will become more apparent by describing in further detail exemplary embodiments thereof with reference to the accompanying drawings, in which.

DETAILED DESCRIPTION

Figure 1:
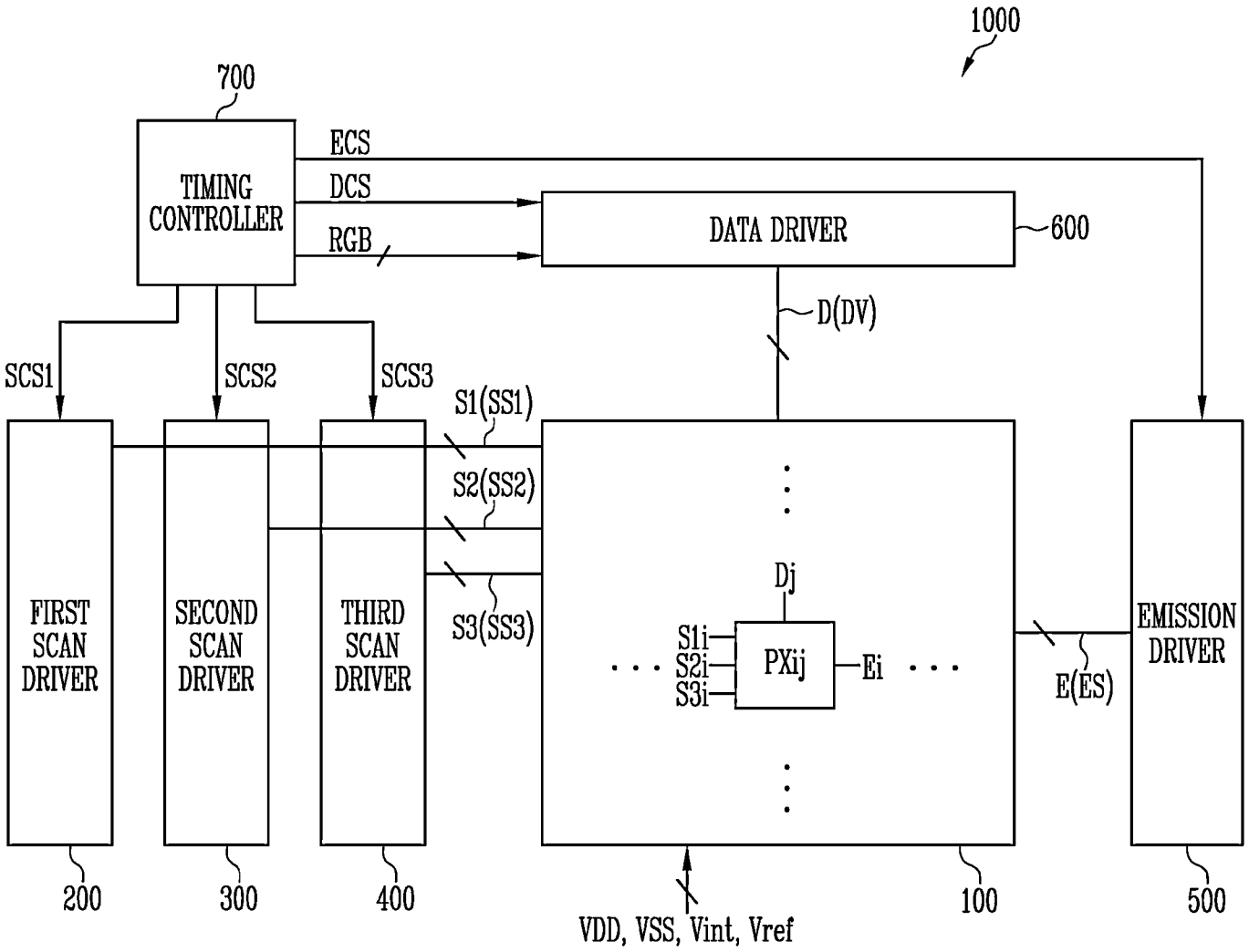
FIG. 1 is a block diagram illustrating an embodiment of a display device in accordance with the invention.

Various embodiments of the invention will hereinafter be described in detail with reference to the accompanying drawings. The same reference numerals are used throughout the different drawings to designate the same components, and repetitive description of the same components will be omitted.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). The term "about" can mean within one or more standard deviations, or within ±30%, 20%, 10%, 5% of the stated value, for example.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

FIG. 1 is a block diagram illustrating an embodiment of a display device in accordance with the invention.

Referring to FIG. 1, the display device 1000 may include a pixel component 100, scan drivers 200, 300, and 400, an emission driver 500, a data driver 600, and a timing controller 700.

In an embodiment, the scan drivers 200, 300, and 400 may be divided into the first scan driver 200, the second scan driver 300, and the third scan driver 400 in terms of configuration and operation. However, the division of the scan drivers is for convenience of description, and at least some of the scan drivers and the emission driver may be integrated into one driving circuit, module, or the like, according to design.

The display device 1000 may display an image at various frame frequencies (or an image refresh rate, a screen refresh rate, and a driving frequency) according to driving conditions. The frame frequency is a frequency at which the data signal is substantially written to the driving transistor of the pixel PXij (where i and j are positive integers). In an embodiment, the frame frequency is also referred to as a screen refresh rate, and represents the frequency at which a display screen is refreshed for one second, for example.

In an embodiment, the frame frequency may be a frequency at which a data signal (data voltage) is substantially written to the pixel PXij. The pixel PXij may be a pixel disposed in an i-th row and a j-th column. In case that the data signal is written to the pixel PXij in response to a scan signal output from the first scan driver 200, the output frequency of the scan signal SS1*i* supplied to the i-th first scan line S1*i* may be a frame frequency. In an embodiment, a frame frequency for driving a video may be a frequency of about 60 hertz (Hz) or more (e.g., about 120 Hz), for example. In this case, a scan signal output from the first scan driver 200 may be supplied to each horizontal line (pixel row) 60 times per second.

In an embodiment, the display device 1000 may adjust the output frequency of the first to third scan drivers 200, 300, and 400, the output frequency of the emission driver 500, and the output frequency of the data driver 600 according to driving conditions. In an embodiment, the display device 1000 may display images in response to various frame frequencies ranging from about 1 Hz to about 120 Hz, for example. However, this is merely illustrative, and the display device 1000 may display an image even at the frame frequency of about 120 Hz or higher (e.g., about 240 Hz or about 480 Hz).

The pixel component 100 includes pixels disposed to be connected to data lines D, first to third scan lines S1, S2, and S3, and emission control lines E. In an embodiment, the pixel PXij may be connected to an i-th first scan line S1*i*, an i-th second scan line S2*i*, an i-th third scan line S3*i*, an i-th emission control line Ei, and a j-th data line Dj, for example. The pixel PXij may include a driving transistor, a plurality of switching transistors, and a plurality of capacitors.

The pixel PXij may be supplied with a first supply voltage VDD, a second supply voltage VSS, a third supply voltage Vref (e.g., a reference voltage), and a fourth supply voltage Vint (e.g., an initialization voltage) from an external device.

In an embodiment, the timing controller 700 may be supplied with input image data and timing signals from a host system such as an application processor ("AP") through a predetermined interface.

In an embodiment, the timing controller 700 may generate a data driving control signal DCS based on timing signals such as input image data, a vertical synchronization signal, a horizontal synchronization signal, and a data enable signal. The data driving control signal DCS may be supplied to the data driver 600. Further, the timing controller 700 may rearrange input image data to supply generated image data RGB to the data driver 600.

The timing controller 700 may supply a first scan driving control signal SCS1, a second scan driving control signal SCS2, and a third scan driving control signal SCS3 to the first scan driver 200, the second scan driver 300, and the third scan driver 400, respectively, based on the timing signals.

The timing controller 700 may supply the emission driving control signal ECS to the emission driver 500 based on the timing signals. The emission driving control signal ECS may include an emission control start signal and clock signals. The emission driving control signal ECS may control the first output timing of the emission control signal, and may be used to shift the emission control signal.

The first scan driving control signal SCS1 may control the first output timing of the scan signal (hereinafter also referred to as the first scan signal SS1) output from the first scan driver 200, and may be used to shift the first scan signal SS1.

The second scan driving control signal SCS2 may control the first output timing of the scan signal (hereinafter also referred to as the second scan signal SS2) output from the second scan driver 300, and may be used to shift the second scan signal SS2.

The third scan driving control signal SCS3 may control the first output timing of the scan signal (hereinafter also referred to as the third scan signal S S3) output from the third scan driver 400, and may be used to shift the third scan signal SS3.

The data driver 600 may convert the image data RGB into an analog data signal DV. The data driver 600 may supply the analog data signals DV to pixels through the data lines D in response to a data driving control signal DCS.

The data driver 600 may supply the data signals DV to the data lines D during a frame period in response to a frame frequency. In an embodiment, the data signal DV supplied to the data lines D may be supplied to be synchronized with the first scan signal SS1 supplied to the first scan lines S1, for example.

The first scan driver 200 may supply first scan signals SS1 to first scan lines S1 in response to the first scan driving control signal SCS1. In an embodiment, the first scan driver 200 may successively supply first scan signals SS1 to the first scan lines S1, for example.

In an embodiment, the data signal DV may be supplied to the pixel PXij in response to the first scan signal SS1*i* supplied to the i-th first scan line S1*i*.

The first scan driver 200 may supply first scan signals SS1 to the first scan lines S1 at the same frequency as the frame frequency of the display device 1000. In an embodiment, the first scan driver 200 may supply scan signals to the first scan lines S1 in a first non-emission period of one frame, for example.

The second scan driver 300 may supply second scan signals SS2 to second scan lines S2 in response to the second scan driving control signal SCS2. In an embodiment, the second scan driver 300 may successively supply second scan signals SS2 to the second scan lines S2, for example.

In an embodiment, a fourth supply voltage Vint may be supplied to a first electrode (e.g., an anode electrode) of the light-emitting element of the pixel PXij and one terminal of the storage capacitor in response to the second scan signal SS2*i*.

The second scan driver 300 may supply the second scan signals SS2 to the second scan lines S2 in the first non-emission period and the second non-emission period of one frame. In an embodiment, during one frame, the second scan signal SS2*i* may be supplied to the i-th second scan line S2*i* multiple times, for example.

The number of second non-emission periods included in one frame may vary depending on the frame frequency. In an embodiment, as the frame frequency decreases, the time of one frame increases, for example. Accordingly, the repetition number of the second non-emission periods may increase. In this case, within one frame period, an operation of sequentially outputting the second scan signal SS2 to the second scan lines S2 (e.g., the second non-emission period) may be repeated multiple times in a predetermined period.

The third scan driver 400 may supply third scan signals SS3 to third scan lines S3 in response to the third scan driving control signal SCS3. In an embodiment, the third scan driver 400 may successively supply third scan signals SS3 to the third scan lines S3, for example.

In an embodiment, the third supply voltage Vref may be supplied to the gate electrode of the driving transistor of the pixel PXij in response to the third scan signal SS3*i* supplied to the i-th third scan line S3*i*.

The third scan driver 400 may supply third scan signals SS3 to the third scan lines S3 at the same frequency as the frame frequency of the display device 1000. In an embodiment, the third scan driver 400 may supply scan signals to the third scan lines S3 in the first non-emission period of one frame, for example.

The first to third scan signals SS3 may have a gate-on voltage (e.g., a logic high voltage) so that each of the transistors included in the pixel PXij may be turned on.

The emission driver 500 may supply emission control signals ES to control lines E, based on the emission driving control signal ECS. In an embodiment, the emission driver 500 may sequentially supply the emission control signals ES to the emission control lines E, for example.

The emission control signal ES is set to a gate-off voltage (e.g., a logic low voltage) so that some transistors (e.g., N-type transistors) included in the pixels PX are turned off. In an embodiment, the supply of the first supply voltage VDD to the driving transistor of the pixel PXij may be stopped in response to the emission control signal ESi.

In an embodiment, in the same manner as the second scan driver 300, the emission driver 500 may supply emission control signals ES to the emission control lines E in the first non-emission period and the second non-emission period.

Thus, in case that the frame frequency is decreased, the repetition number of the operation of supplying the emission control signal ES within one frame period may be increased.

Each of the first, second, and third scan drivers 200, 300, and 400 and the emission driver 500 may be disposed (e.g., mounted) on a substrate through a thin-film process. Further, at least one of the first, second, and third scan drivers 200, 300, and 400 may be disposed on opposite sides with the pixel component 100 interposed therebetween. The emission driver 500 may be disposed on opposite sides with the pixel component 100 interposed therebetween.

The pixel PXij disposed on a current horizontal line (or a current pixel row) corresponding to the circuit structure of the pixel PXij may be further connected to a scan line disposed on a previous horizontal line (or a previous pixel row) and/or a subsequent horizontal line (or a subsequent pixel row). To this end, the pixel component 100 may further include dummy scan lines and/or dummy emission control lines, which are not illustrated.

In an embodiment, the display device 1000 may further include a power supply component which generates a first supply voltage VDD, a second supply voltage VSS, a third supply voltage Vref, and a fourth supply voltage Vint based on an external power source.

Figure 2:
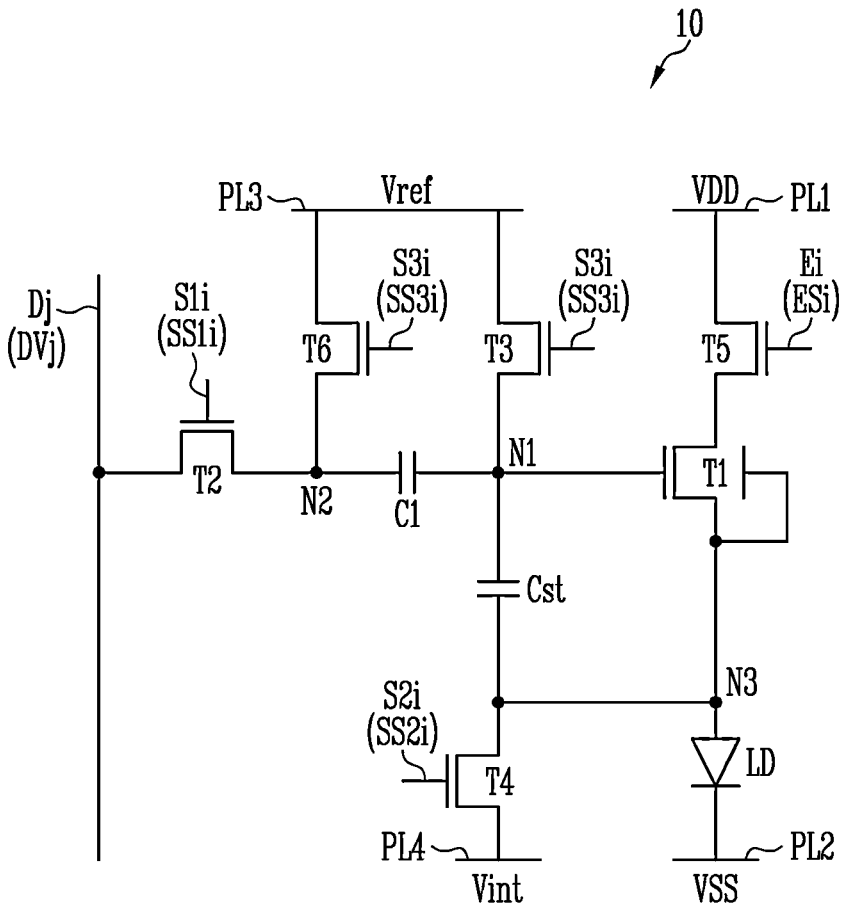
FIG. 2 is a circuit diagram illustrating an embodiment of a pixel included in the display device of FIG. 1.

FIG. 2 is a circuit diagram illustrating an embodiment of a pixel included in the display device of FIG. 1.

In FIG. 2, for the sake of description, there is illustrated a pixel 10 that is disposed on the i-th horizontal line and connected to the j-th data line Dj.

Referring to FIGS. 1 and 2, the pixel 10 may include a light-emitting element LD, first to sixth transistors T1 to T6, a storage capacitor Cst, and a first capacitor C1.

A first electrode (e.g., anode electrode) of the light-emitting element LD may be connected to the third node N3, and a second electrode (e.g., cathode electrode) thereof may be connected to the second power line PL2 that transmits the second supply voltage VSS. The light-emitting element LD may generate light having a predetermined luminance corresponding to current supplied from the first transistor T1.

The second power line PL2 may have a line shape, but is not limited thereto. In an embodiment, the second power line PL2 may be a conductive layer in the form of a conductive plate, for example.

In an embodiment, the light-emitting element LD may be an organic light-emitting diode including an organic light-emitting layer. In an embodiment, the light-emitting element LD may be an inorganic light-emitting element including inorganic material. In an embodiment, the light-emitting element LD may be a light-emitting element including a composite of an inorganic material and an organic material. The light-emitting element LD may have a shape in which a plurality of inorganic light-emitting elements is connected in parallel and/or series between the second power line PL2 and the third node N3.

In an embodiment, the first to sixth transistors T1 to T6 may be oxide semiconductor transistors. In an embodiment, the first to sixth transistors T1 to T6 may be oxide semiconductor transistors as an active layer (semiconductor layer), for example. Hereinafter, the first to sixth transistors T1 to T6 will be described as oxide semiconductor transistors that are N-type oxide semiconductor transistors. However, this is merely illustrative, and at least one of the first to sixth transistors T1 to T6 may be replaced with a polysilicon semiconductor transistor or the like. Further, at least one of the first to sixth transistors T1 to T6 may be replaced with a P-type transistor.

The first transistor (or the driving transistor) T1 may include a first electrode connected to the fifth transistor T5, and a second electrode connected to a third node N3. In an embodiment, the first transistor T1 may include a first gate electrode and a second gate electrode (e.g., a back gate electrode).

The first transistor T1 may control, in response to the voltage of the first node N1, driving current flowing from the first power line PL1 to the second power line PL2 via the light-emitting element LD. In an embodiment, the first supply voltage VDD may be set to a voltage higher than the second supply voltage VSS, for example.

The first gate electrode of the first transistor T1 may be connected to the first node N1. The second gate electrode of the first transistor T1 may be connected to the third node N3.

As the second gate electrode of the first transistor T1 is connected to the third node N3 (e.g., a source electrode of the first transistor T1), the gate-source voltage and driving current of the first transistor T1 may be stably maintained, and the emission luminance of the light-emitting element LD may be stabilized.

The second transistor T2 may be connected between the j-th data line Dj (hereinafter, also referred to as the data line) and the second node N2. The gate electrode of the second transistor T2 may be connected to the i-th first scan line S1*i* (hereinafter, also referred to as the first scan line). When a first scan signal SS1*i* is supplied to the first scan line S1*i*, the second transistor T2 may be turned on to electrically connect the j-th data line Dj and the second node N2.

The third transistor T3 may be connected between the third power line PL3 and the first node N1. A third supply voltage Vref (e.g., a reference voltage) may be supplied to the third power line PL3. In an embodiment, the third supply voltage Vref may be about 0 volt (V) to about 3V, for example.

The gate electrode of the third transistor T3 may be connected to an i-th third scan line S3*i* (hereinafter, also referred to as a third scan line). When a third scan signal SS3*i* is supplied to the third scan line S3*i*, the third transistor T3 may be turned on to supply the third supply voltage Vref to the first node N1 (e.g., the gate electrode of the first transistor T1).

The fourth transistor T4 may be connected between the third node N3 and the fourth power line PL4. A fourth supply voltage Vint (e.g., an initialization voltage) may be supplied to the fourth power line PL4. In an embodiment, the fourth supply voltage Vint may be about −3V to about 3V, for example.

The gate electrode of the fourth transistor T4 may be connected to an i-th second scan line S2*i* (hereinafter, also referred to as a second scan line). When a second scan signal SS2*i* is supplied to the second scan line S2*i*, the fourth transistor T4 may be turned on to supply the fourth supply voltage Vint to the third node N3 (i.e., the first electrode of the light-emitting element LD).

The fifth transistor T5 may be connected between the first power line PL1 and the first transistor T1. The gate electrode of the fifth transistor T5 may be connected to the i-th emission control line Ei (hereinafter, also referred to as the emission control line). The fifth transistor T5 may be turned off when an emission control signal ESi is supplied to the emission control line Ei, and may be turned on in the other cases. when the fifth transistor T5 is turned on, the first transistor T1 may be electrically connected to the first power line PL1.

The sixth transistor T6 may be connected between the third power line PL3 and the second node N2. The gate electrode of the sixth transistor T6 may be connected to the third scan line S3*i*. When a third scan signal SS3*i* is supplied to the third scan line S3*i*, the sixth transistor T6 may be turned on to supply the third supply voltage Vref to the second node N2.

The storage capacitor Cst may be connected between the first node N1 and the third node N3. The storage capacitor Cst may store a difference in voltage between the first node N1 and the third node N3. Further, the storage capacitor Cst may store voltage based on the data signal DVj.

The first transistor T1 may be an N-type transistor, and the gate-source voltage and driving current of the first transistor T1 may be greatly affected by the change in voltage of the third node N3, which is the source voltage. In an embodiment, the source voltage of the first transistor T1 may greatly fluctuate due to the current-resistance ("IR") drop on the second power line PL2, and accordingly, the driving current may be unintentionally changed. Particularly in a medium-sized or large-sized display panel, the IR drop and image quality deterioration (luminance deviation, etc.) due to the IR drop may be increased, for example.

The storage capacitor Cst may maintain the gate-source voltage of the first transistor T1. Thus, as the capacity (capacitance) of the storage capacitor Cst increases, it may be easy to compensate for the source voltage change due to the IR drop by the second power line PL2.

However, in case that the capacitance of the storage capacitor Cst is set large, the voltage of the data signal DVj may be distributed by parasitic capacitors connected in series to the storage capacitor Cst, and the voltage actually applied to the first node N1 may be lower than the voltage supplied to the data line Dj. Therefore, in order for a voltage of a desired level to be applied to the first node N1 for light emission, the voltage of the actual data signal DVj supplied to the data line Dj should be increased, and a data swing range increases. In an embodiment, in case that a voltage in the range of about 0V to about 6V is desired to be supplied to the first node N1 to generate a driving current, the data swing range may increase to a range greater than about 0V to about 6V as the capacitance of the storage capacitor Cst increases, for example. Therefore, an increase in power consumption due to an increase in the capacitance of the storage capacitor Cst may occur.

The first capacitor C1 may be added to improve a trade-off caused by an increase in the capacitance of the storage capacitor Cst.

The first capacitor C1 may be connected between the first node N1 and the second node N2. When the data signal DVj is supplied to the second node N2, which is one end of the first capacitor C1, the voltage of the first node N1 and the gate-source voltage of the first transistor T1 may be determined according to the capacitance ratio of the first capacitor C1 and the storage capacitor Cst.

In an embodiment, the capacitance of the storage capacitor Cst may be greater than the capacitance of the first capacitor C1. In an embodiment, an area of the storage capacitor Cst may be greater than an area of the first capacitor C1, for example. In an embodiment, the capacitance of the storage capacitor Cst may be more than twice the capacitance of the first capacitor C1, for example.

In an embodiment, in case that the voltage at both ends between the second node N2 and the third node N3 is V, the capacitance of the first capacitor C1 is A, and the capacitance of the storage capacitor Cst is B, the voltage between both ends of the storage capacitor Cst may be determined as (V×B/(A+B)), for example. Thus, as the capacitance B of the storage capacitor Cst increases, the voltage of the first node N1 may approach a voltage value supplied to the second node N2. Accordingly, there is no need to increase the data swing range.

Thus, power consumption may be reduced as the data swing range is reduced, and image quality may be improved as compensation for voltage drop is enhanced by the second power line PL2.

Figure 3:
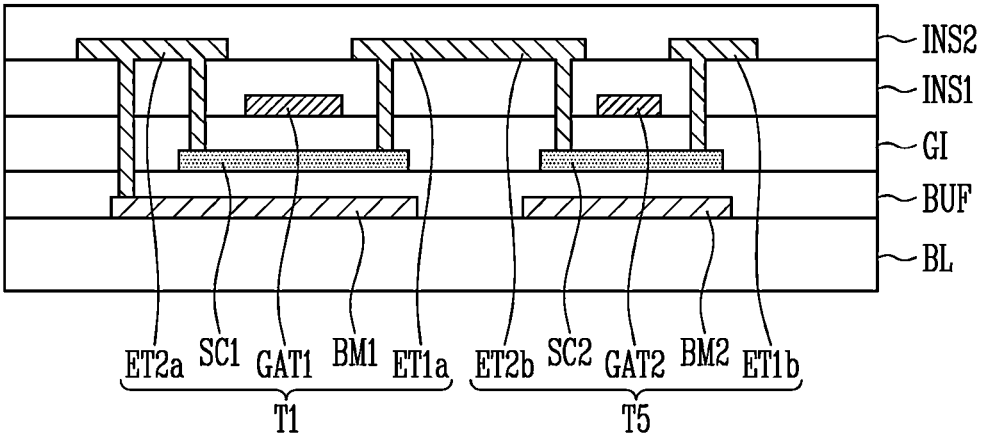
FIG. 3 is a cross-sectional view illustrating an embodiment of transistors included in the pixel of FIG. 2.

FIG. 3 is a cross-sectional view illustrating an embodiment of transistors included in the pixel of FIG. 2.

Referring to FIGS. 2 and 3, the transistors T1 to T6 of the pixel 10 may be formed in a backplane structure.

FIG. 3 shows the first transistor T1 and the fifth transistor T5 of the pixel 10 of FIG. 2.

The pixel 10 may include a base layer BL, a buffer layer BUF, insulating layers GI, INS1, and INS2, semiconductor patterns SC1 and SC2, and conductive patterns GAT1, GAT2, BM1, BM2, ET1*a*, ET2*a*, ET1*b*, and ET2*b*.

The first transistor T1 may include the first lower conductive pattern BM1 (e.g., a back gate electrode), the first semiconductor pattern SC1, the first gate electrode GAT1, the first electrode ET1*a*, and the second electrode ET2*a*.

The fifth transistor T5 may include the second lower conductive pattern BM2, the second semiconductor pattern SC2, the second gate electrode GAT2, the first electrode ET1*b*, and the second electrode ET2*b*.

The base layer BL may be a rigid or flexible substrate or film. In an embodiment, the base layer BL may include a glass substrate, a quartz substrate, a glass ceramic substrate, a crystalline glass substrate or the like, for example. In an alternative embodiment, the base layer BL may include a polymer organic substrate including polyimide, polyamide, or the like, a plastic substrate, etc.

In an embodiment, the first lower conductive pattern BM1 and the second lower conductive pattern BM2 may be disposed on the base layer BL. The first lower conductive pattern BM1 may overlap the first semiconductor pattern SC1 and the first gate electrode GAT1. The second lower conductive pattern BM2 may overlap the second semiconductor pattern SC2 and the second gate electrode GAT2.

The first lower conductive pattern BM1 and the second lower conductive pattern BM2 may include a metal material.

In an embodiment, the first lower conductive pattern BM1 may be the back gate electrode of the first transistor T1. The first lower conductive pattern BM1 may be electrically connected to the second electrode ET2*a* of the first transistor T1.

In an embodiment, the second lower conductive pattern BM2 may be another gate electrode of the fifth transistor T5. The second lower conductive pattern BM2 may be connected in common to the emission control line Ei together with the second gate electrode GAT2.

The second to sixth transistors T2 to T6 are oxide semiconductor transistors and have light sensitive characteristics. The fifth transistor T5 serving as a switching transistor may include the second lower conductive pattern BM2 which is an opaque metal and may be disposed as a gate electrode under the second semiconductor pattern SC2 to improve reliability and switching performance. In other words, the fifth transistor T5 may have a dual gate structure.

In an embodiment, the second, third, fourth, and sixth transistors T2, T3, T4, and T6 may also have a stack structure similar to that of the fifth transistor T5.

However, this is merely illustrative, and the second lower conductive pattern BM2 may be a floating electrode that does not serve as a gate electrode and simply serves to block light. Further, at least one of the second to sixth transistors T2 to T6 may not have a lower conductive pattern.

The buffer layer BUF may be disposed on the base layer BL and the lower conductive patterns BM1 and BM2. The buffer layer BUF may prevent impurities from diffusing into the circuit element from an outside. In an embodiment, the buffer layer BUF may include at least one of metal oxides such as silicon nitride ($SiN_x$), silicon oxide ($SiO_x$), silicon oxynitride ($SiO_xN_y$), and aluminum oxide ($AlO_x$). In an embodiment, the buffer layer BUF may be formed to have the thickness of about 5000 angstroms (Å), for example. In some embodiments, the buffer layer BUF may be omitted.

The insulating layers GI, INS1, and INS2 may be sequentially disposed on the buffer layer BUF, and may include a gate insulating layer GI, a first insulating layer INS1, and a second insulating layer INS2.

Each of the insulating layers GI, INS1, and INS2 may have a single-layer structure or a multi-layer structure, and may include at least one inorganic insulating material and/or organic insulating material. In an embodiment, each of the insulating layers GI, INS1, and INS2 may include various types of currently available organic/inorganic insulating materials, including $SiN_x$, for example. Further, the insulating layers GI, INS1, and INS2 may include different insulating materials, or at least some of the insulating layers GI, INS1, and INS2 may include the same insulating material as each other.

The first semiconductor pattern SC1 and the second semiconductor pattern SC2 may be disposed on the buffer layer BUF. Each of the first semiconductor pattern SC1 and the second semiconductor pattern SC2 may include a channel area, a source area and a drain area on opposite sides of the channel area.

Each of the first semiconductor pattern SC1 and the second semiconductor pattern SC2 may be a semiconductor pattern including an oxide semiconductor or the like. The channel area of each of the first semiconductor pattern SC1 and the second semiconductor pattern SC2, which is an undoped semiconductor pattern, may be an intrinsic semiconductor. Each of the source area and the drain area may be a semiconductor pattern doped with a predetermined impurity.

In an embodiment, each of the first gate electrode GAT1, the second gate electrode GAT2, the first electrodes ET1*a* and ET1*b*, and the second electrodes ET2*a* and ET2*b* may include at least one conductive material, for example, Ag, Mg, Al, Pt, Pd, Au, Ni, Nd, Ir, Cr, Ti, and any alloys thereof, but is not limited thereto.

The first gate electrode GAT1 and the second gate electrode GAT2 may be disposed on the gate insulating layer GI. The first gate electrode GAT1 may overlap the channel area of the first semiconductor pattern SC1, and the second gate electrode GAT2 may overlap the channel area of the second semiconductor pattern SC2.

The first electrode ET1*a* of the first transistor T1 may be connected to the drain area of the first semiconductor pattern SC1 through a contact hole passing through the first insulating layer INS1 and the gate insulating layer GI. The first electrode ET1*a* of the first transistor T1 may be a drain electrode. Further, the first electrode ET1*a* of the first transistor T1 may be connected to the second electrode ET2*b* of the fifth transistor T5.

The second electrode ET2*a* of the first transistor T1 may be connected to the source area of the first semiconductor pattern SC1 through a contact hole passing through the first insulating layer INS' and the gate insulating layer GI. The second electrode ET2*a* of the first transistor T1 may be a source electrode. Further, the second electrode ET2*a* of the first transistor T1 may be connected to the first lower conductive pattern BM1.

As the first lower conductive pattern BM1 (back gate electrode) is connected to the second electrode ET2*a* of the first transistor T1, the gate-source voltage and driving current of the first transistor T1 may be stably maintained, and the emission luminance of the light-emitting element LD may be stabilized.

The first electrode ET1*b* of the fifth transistor T5 may be connected to the drain area of the second semiconductor pattern SC2 through a contact hole passing through the first insulating layer INS1 and the gate insulating layer GI. The first electrode ET1*b* of the fifth transistor T5 may be a drain electrode.

The second electrode ET2*b* of the fifth transistor T5 may be connected to the source area of the second semiconductor pattern SC2 through a contact hole passing through the first insulating layer INS1 and the gate insulating layer GI. The second electrode ET2*b* of the fifth transistor T5 may be a source electrode.

Figure 4:
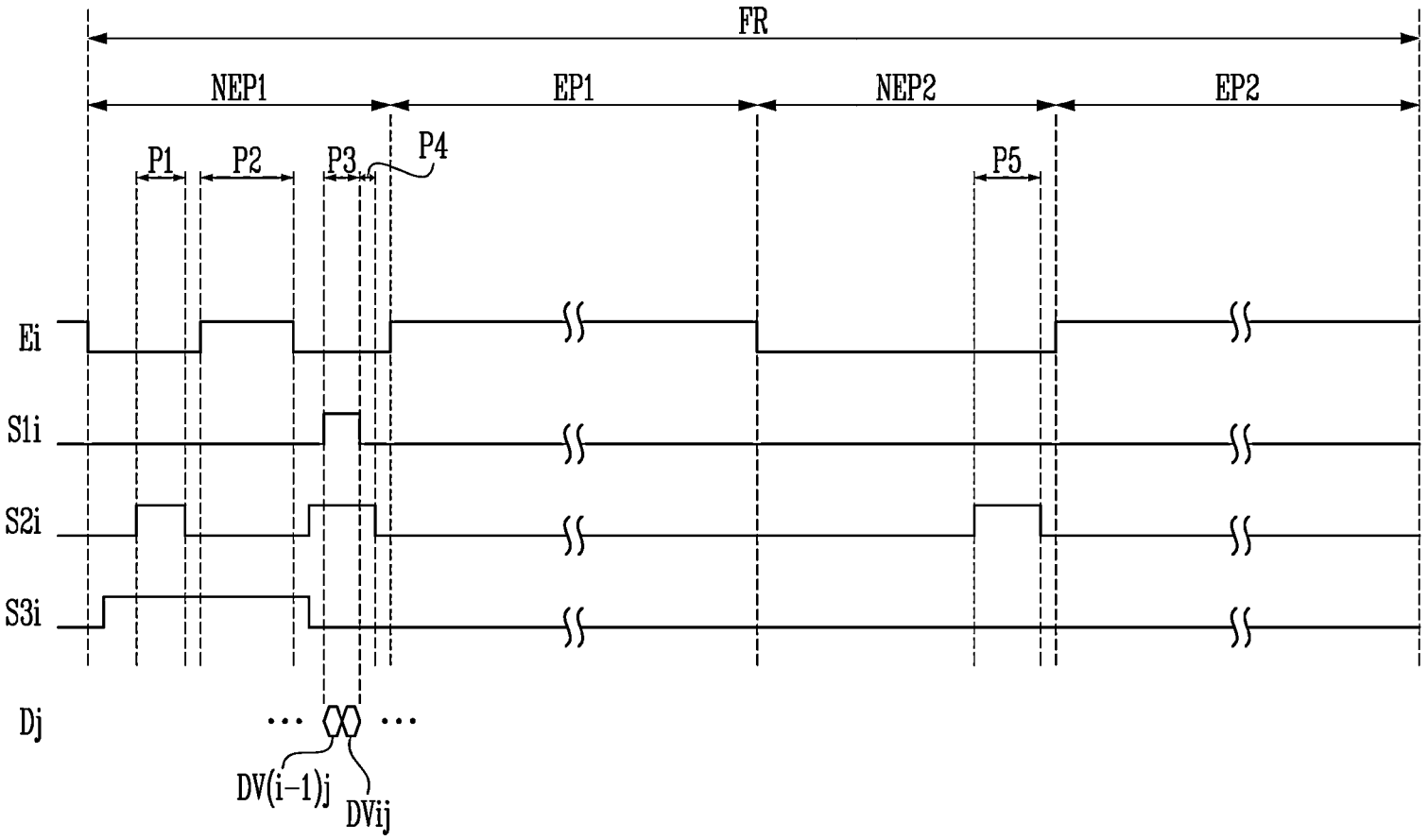
FIG. 4 is a timing diagram illustrating an embodiment of signals supplied to the pixel of FIG. 2.

FIG. 4 is a timing diagram illustrating an embodiment of signals supplied to the pixel of FIG. 2.

Referring to FIGS. 2 and 4, in variable frequency driving for controlling the frame frequency, one frame period FR may include one first non-emission period NEP1 and at least one second non-emission period NEP2.

A first emission period EP1 may be inserted between the first non-emission period NEP1 and the second non-emission period NEP2, and a second emission period EP2 may follow the second non-emission period NEP2. In the first non-emission period NEP1 and the second non-emission period NEP2, the emission control signal ESi may be supplied to the emission control line Ei. In other words, the emission control signal ESi may be a signal level that turns off the fifth transistor T5.

The second non-emission period NEP2 and the second emission period EP2 may be inserted for low-frequency driving to reduce power consumption. Although FIG. 4 illustrates that a frame period FR includes one second non-emission period NEP2 and second emission period EP2, the invention is not limited thereto. In an embodiment, when the frame frequency is further reduced, the operations of the second non-emission period NEP2 and the second emission period EP2 may be repeated in the frame period FR, for example.

The first non-emission period NEP1 may include a period (e.g., a third period P3) in which a j-th data signal DVj actually corresponding to an output image is written. In an embodiment, in a second period P2 of the first non-emission period NEP1, the emission control signal ESi may have a gate-on level. In this case, the light-emitting element LD does not emit light due to threshold voltage compensation. Therefore, the second period P2 may be included in the first non-emission period NEP1.

In an embodiment, the first scan signal SS1*i* and the third scan signal SS3*i* may be supplied in the first non-emission period NEP1. In an embodiment, the second scan signal SS2*i* may be supplied in the first non-emission period NEP1 and the second non-emission period NEP2. The second scan signal SS2*i* may be supplied multiple times in the first non-emission period NEP1.

In an embodiment, the first non-emission period NEP1 may include first to fourth periods P1 to P4.

Before the first period P1, the third scan signal SS3*i* may be supplied to the third scan line S3*i*, and the third transistor T3 and the sixth transistor T6 may be turned on. The third scan signal SS3*i* may be supplied during the first period P1 and the second period P2. The third transistor T3 and the sixth transistor T6 may be turned on during the first period P1 and the second period P2. Thus, the third supply voltage Vref may be supplied to the first node N1 and the second node N2 in the first period P1 and the second period P2. Therefore, voltages at both ends of the first capacitor C1 may be initialized to the third supply voltage Vref.

In the first period P1, the second scan driver 300 may supply the second scan signal SS2*i* to the second scan line S2*i*. In response to the second scan signal SS2*i*, the fourth transistor T4 may be turned on, and the fourth supply voltage Vint may be transmitted to the third node N3. Thus, a voltage of Vref−Vint may be stored in the storage capacitor Cst. The first period P1 may be a period in which voltages on both ends of the first capacitor C1 and the storage capacitor Cst are initialized.

In the second period P2, the supply of the second scan signal SS2*i* may be stopped, and the second and fourth transistors T2 and T4 may be turned off. In the second period P2, the supply of the emission control signal ESi may be stopped, and the fifth transistor T5 may be turned on. Thus, during the second period P2, current may flow to the first transistor Ti, and a voltage corresponding to a difference between the third supply voltage Vref and the threshold voltage of the first transistor T1 may be applied to the third node N3.

Thus, the threshold voltage of the first transistor T1 may be stored in the storage capacitor Cst. In other words, the second period P2 may be a threshold voltage compensation period.

Subsequently, the fifth transistor T5 may be turned off by supplying the emission control signal ESi before the first emission period EP1.

Thereafter, before the third period P3, the second scan driver 300 may supply the second scan signal SS2*i* to the second scan line S2*i*. Thus, the fourth transistor T4 may be turned on, and the fourth supply voltage Vint may be supplied to the third node N3. Here, the storage capacitor Cst may maintain a state in which the threshold voltage is stored, by the coupling of the storage capacitor Cst.

Thereafter, the supply of the third scan signal SS3*i* may be stopped in the third period P3, so the third transistor T3 and the sixth transistor T6 may be turned off. Further, in the third period P3, the first scan driver 200 may supply the first scan signal SS1*i* to the first scan line S1*i*, and the second scan driver 300 may supply the second scan signal SS2*i* to the second scan line S2*i*.

In response to the first scan signal SS1*i*, the second transistor T2 may be turned on, and the data signal provided to the data line Dj may be supplied to the second node N2. In response to the second scan signal SS2*i*, the fourth transistor T4 may be turned on, and the third node N3 may have the fourth supply voltage Vint.

Thus, data may be written in a state in which the voltage of one end (i.e., the third node N3) of the storage capacitor Cst is fixed to the fourth supply voltage Vint, which is constant power. The voltage of the data signal DVj may be distributed depending on the capacitance ratio between the first capacitor C1 and the storage capacitor Cst. Therefore, the storage capacitor Cst may store a voltage in which the threshold voltage is reflected in the result of dividing a difference between the data signal DVj and the fourth supply voltage Vint.

As described above, in case that the capacitance of the storage capacitor Cst is sufficiently large, most of the voltage value of the data signal DVj may be stored at both ends of the storage capacitor Cst. Therefore, a data swing range and power consumption are not increased.

As described above, the third period P3 may be a data writing period. In other words, the threshold voltage compensation period (the second period P2) and the data writing period (the third period P3) may be separated from each other. Therefore, a sufficient amount of time desired for the threshold voltage compensation may be secured.

In an embodiment, the third period P3 that is the data writing period may be two or more horizontal cycles. In an embodiment, as shown in FIG. 4, the third period P3 and the first scan signal SS1*i* may have two horizontal periods, and in response to the first scan signal SS1*i*, the data signal DV(i−1)j corresponding to the (i−1)-th row and j-th column and the data signal DVij corresponding to the (i−1)-th row and j-th column may be supplied to the data line Dj, for example. Here, since the voltage finally stored in the storage capacitor before the emission of the pixel 10 is related to the data signal DVij, the pixel 10 may emit light having a luminance corresponding to the data signal DVij.

In this case, a part of the scan signal supplied to an i−1-th first scan line connected to the i−1-th pixel may overlap a part of the scan signal supplied to the first scan line S1*i*.

Therefore, when driving a high-resolution panel in which the length of one horizontal cycle is shortened, driving a large panel, and/or driving a high frequency of about 120 Hz or higher, the data writing period may be sufficiently secured and image quality may be improved.

However, this is merely illustrative, and the third period P3 and the pulse width of the first scan signal SS1*i* may be one horizontal cycle.

Thereafter, in the fourth period P4, the supply of the first scan signal SS1*i* may be stopped and the second transistor T2 may be turned off. Since the supply of the second scan signal SS2*i* is maintained, the fourth transistor T4 has a turn-on state in the fourth period P4. Thus, the first electrode of the light-emitting element LD may be initialized to the fourth supply voltage Vint, and the parasitic capacitor of the light-emitting element LD may be discharged. As residual voltage charged into the parasitic capacitor is discharged (removed), unintended fine emission may be prevented. Therefore, the black expression performance of the pixel 10 may be enhanced.

Thereafter, the supply of the second scan signal SS2*i* may be stopped, the supply of the emission control signal ESi to the emission control line Ei may be stopped, and the first emission period EP1 may proceed.

In the first emission period EP1, driving current may be generated based on the voltage stored in the storage capacitor Cst, and the light-emitting element LD may emit light in response to the driving current.

In the second non-emission period NEP2, the emission control signal ESi may be supplied to the emission control line Ei, and the emission of the light-emitting element LD may be stopped. The second non-emission period NEP2 may include a fifth period P5.

In the fifth period P5, the second scan driver 300 may supply the second scan signal SS2*i* to the second scan line S2*i*. In response to the second scan signal SS2*i*, the fourth transistor T4 may be turned on, and the fourth supply voltage Vint may be supplied to the third node N3. Consequently, the parasitic capacitor of the light-emitting element LD may be discharged. As residual voltage charged into the parasitic capacitor is discharged (removed), emission at an unintended luminance may be prevented in the second non-emission period NEP2.

Thereafter, similarly to the first emission period EP1, in the second emission period EP2, the light-emitting element LD may emit light in the second emission period EP2 based on the voltage stored in the storage capacitor Cst in the third period P3.

As described above, the pixel 10 applied to variable frequency driving including low frequency driving and the display device 1000 including the pixel in embodiments of the invention may include the first capacitor C1 and the sixth transistor T6. Therefore, a data signal DVj is provided to the first transistor T1 according to a capacitance ratio of the first capacitor C1 and the storage capacitor Cst connected in series with each other, so a data swing range for expressing an entire grayscale may be reduced, and thereby power consumption may be reduced, and an area (and capacitance) of the storage capacitor Cst may be greatly increased. Therefore, compensation for a voltage drop caused by the IR drop of the display panel may be enhanced without an increase in power consumption, so that image quality may be improved.

Further, the threshold voltage compensation period (second period P2) and the data writing period (third period P3) are separated from each other, and the data writing period has a time of two or more horizontal cycles, so that threshold voltage compensation time and data writing time may be sufficiently secured. Therefore, the image quality of high resolution panel driving, large panel driving, and/or high frequency driving of about 120 Hz or higher may be improved.

Figure 5:
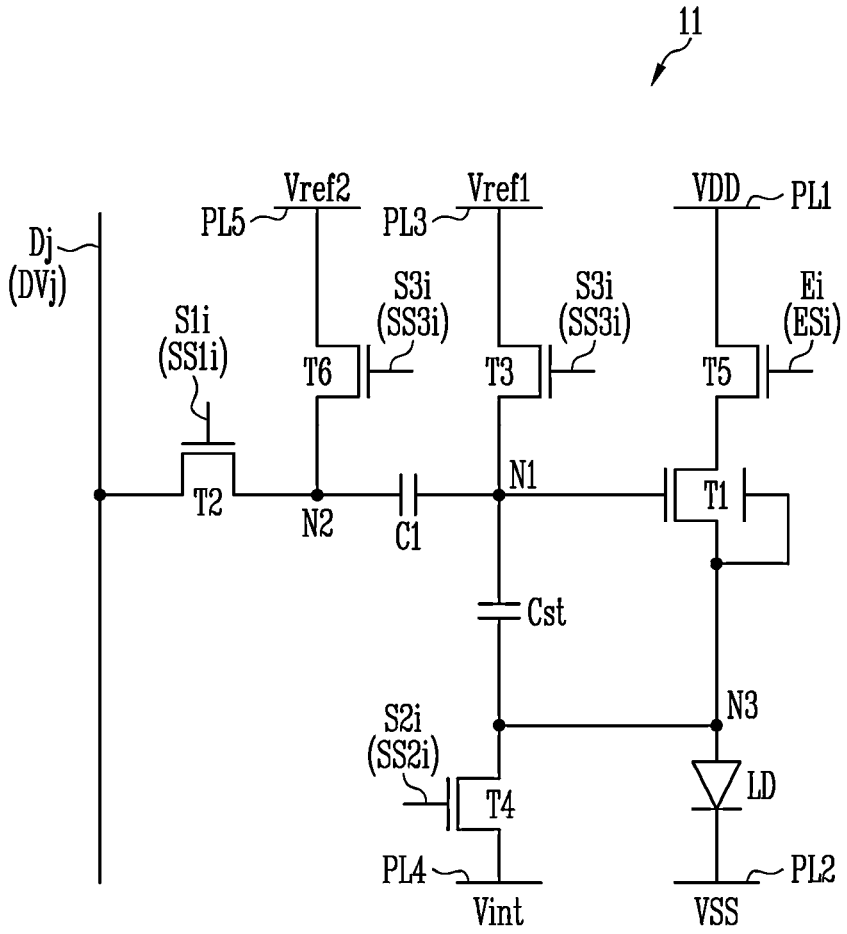
FIG. 5 is a circuit diagram illustrating an embodiment of a pixel included in the display device of FIG. 1.

FIG. 5 is a circuit diagram illustrating an embodiment of a pixel included in the display device of FIG. 1.

In the following description of FIG. 5, the same reference numerals are used to designate the same or similar components as those of FIG. 2, and repetitive description thereof will be omitted.

Referring to FIG. 5, the pixel 11 may include the light-emitting element LD, the first to sixth transistors T1 to T6, the storage capacitor Cst, and the first capacitor C1.

The third transistor T3 may be connected between the third power line PL3 and the first node N1. The third supply voltage Vref1 (e.g., a first reference voltage) may be supplied to the third power line PL3. When the third scan signal SS3*i* is supplied, the third transistor T3 may be turned on to supply the third supply voltage Vref1 to the first node N1 (i.e., the gate electrode of the first transistor T1).

The sixth transistor T6 may be connected between the fifth power line PL5 and the second node N2. The fifth supply voltage Vref2 (e.g., a second reference voltage) may be supplied to the fifth power line PL5. When the third scan signal SS3*i* is supplied, the sixth transistor T6 may be turned on to supply the fifth supply voltage Vref2 to the second node N2.

In an embodiment, the third supply voltage Vref1 and the fifth supply voltage Vref2 may have different voltage values from each other. Thus, different voltages may be supplied to the first node N1 and the second node N2.

The voltage value of the data signal DVj may be divided by a voltage difference between the third supply voltage Vref1 and the fifth supply voltage Vref2 to adjust the value stored in the storage capacitor Cst. Therefore, the data swing range may be adjusted by adjusting the voltage level of each of the third supply voltage Vref1 and the fifth supply voltage Vref2.

Figure 6:
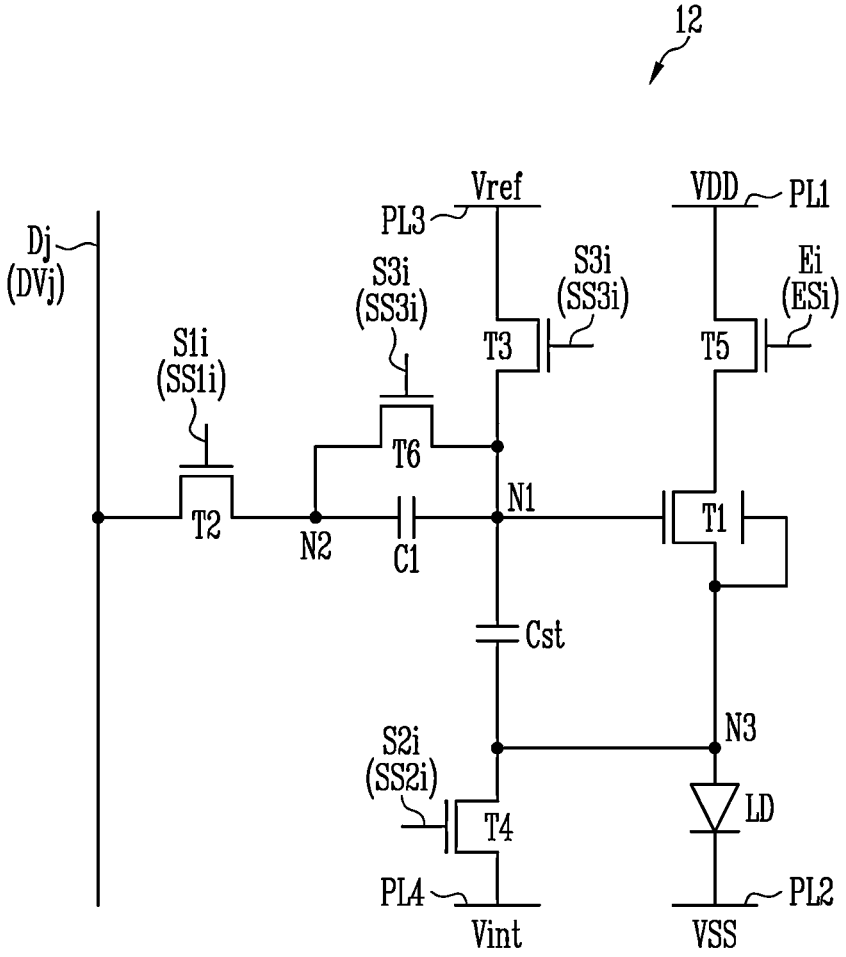
FIG. 6 is a circuit diagram illustrating an embodiment of a pixel included in the display device of FIG. 1.

FIG. 6 is a circuit diagram illustrating an embodiment of a pixel included in the display device of FIG. 1.

In the following description of FIG. 6, the same reference numerals are used to designate the same or similar components as those of FIG. 2, and repetitive description thereof will be omitted.

Referring to FIG. 6, the pixel 12 may include the light-emitting element LD, the first to sixth transistors T1 to T6, the storage capacitor Cst, and the first capacitor C1.

The sixth transistor T6 may be connected between the first node N1 and the second node N2. The gate electrode of the sixth transistor T6 may be connected to the third scan line S3*i*. Thus, the third supply voltage Vref may be supplied through the third transistor T3 and the sixth transistor T6 to the second node N2.

The operation of the pixel 12 may be substantially the same as that of the pixel 10 of FIG. 2. The pixel structure of FIG. 6 may be considered in terms of pixel design and layout.

Figure 7:
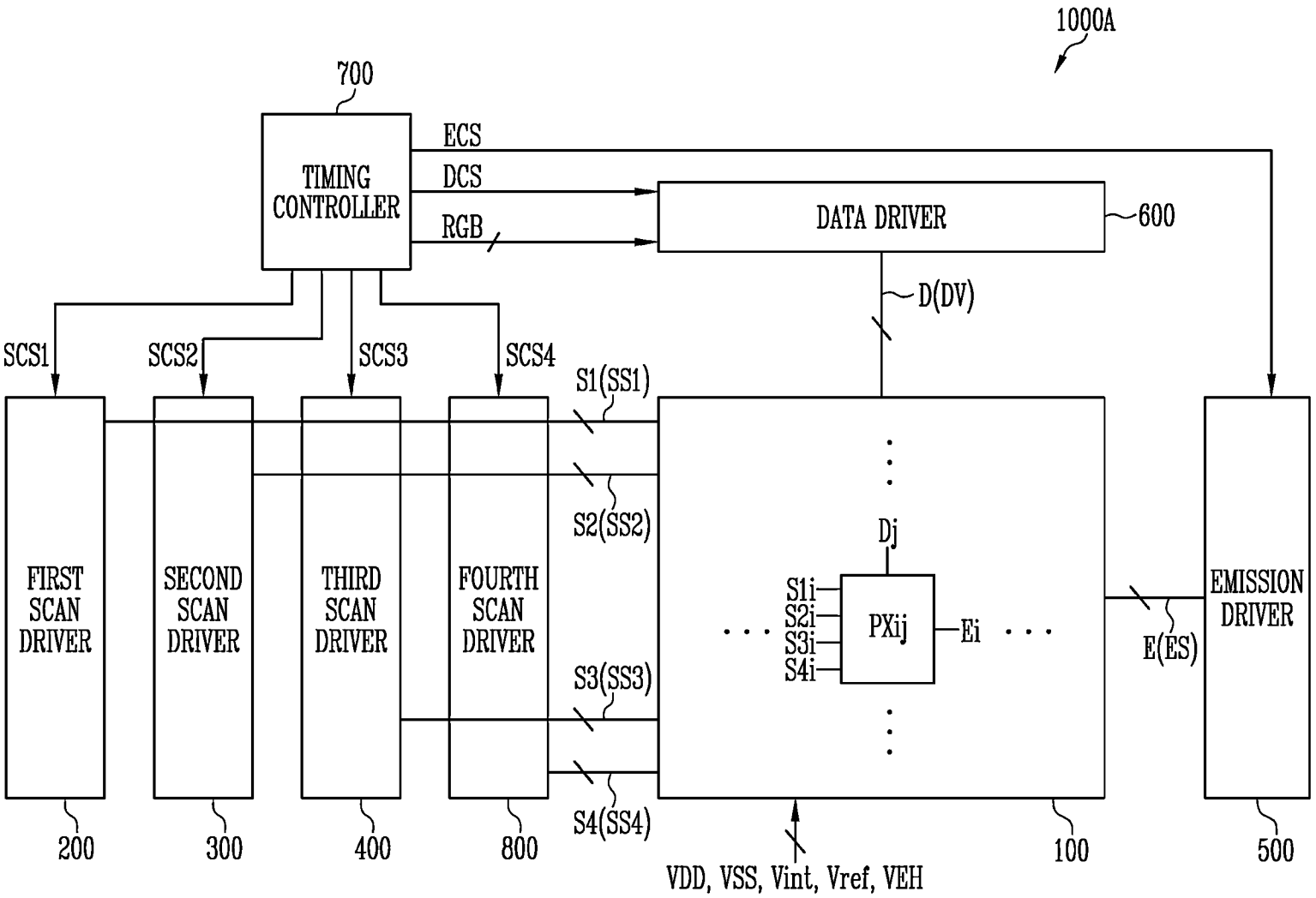
FIG. 7 is a block diagram illustrating an embodiment of a display device in accordance with the invention.

FIG. 7 is a block diagram illustrating an embodiment of a display device in accordance with the invention.

In the following description of FIG. 7, the same reference numerals are used to designate the same or similar components as those of FIG. 1, and repetitive description thereof will be omitted.

Referring to FIG. 7, the display device 1000A may include a pixel component 100, scan drivers 200, 300, 400, and 800, an emission driver 500, a data driver 600, and a timing controller 700.

In an embodiment, the scan drivers 200, 300, 400, and 800 may be divided into of the first scan driver 200, the second scan driver 300, the third scan driver 400, and the fourth scan driver 800 in terms of configuration and operation.

In an embodiment, the pixel PXij may be connected to an i-th first scan line S1*i*, an i-th second scan line S2*i*, an i-th third scan line S3*i*, an i-th fourth scan line S4*i*, an i-th emission control line Ei, and a j-th data line Dj. The pixel PXij may include a driving transistor, a plurality of switching transistors, and a plurality of capacitors.

The pixel PXij may be supplied with a first supply voltage VDD, a second supply voltage VSS, a third supply voltage Vref (e.g., a reference voltage), and a fourth supply voltage Vint (e.g., an initialization voltage) from an external device. In an embodiment, the pixel PXij may be further supplied with a fifth supply voltage VEH.

In an embodiment, the timing controller 700 may further generate a fourth scan driving control signal SCS4 based on timing signals. The fourth scan driving control signal SCS4 may control the first output timing of the scan signal (hereinafter, also referred to as the fourth scan signal) output from the fourth scan driver 800, and may be used to shift the fourth scan signal.

The fourth scan driver 800 may supply fourth scan signals to fourth scan lines S4 in response to the fourth scan driving control signal SCS4. In an embodiment, the fourth scan driver 800 may successively supply fourth scan signals to the fourth scan lines S4, for example.

In an embodiment, the fifth supply voltage VEH may be supplied to the source electrode of the driving transistor of the pixel PXij in response to the fourth scan signal.

The fourth scan driver 800 may supply the fourth scan signals to the fourth scan lines S4 in the first non-emission period and the second non-emission period of one frame. In an embodiment, during one frame, the fourth scan signal may be supplied to the i-th fourth scan line S4*i* multiple times, for example.

Figure 8:
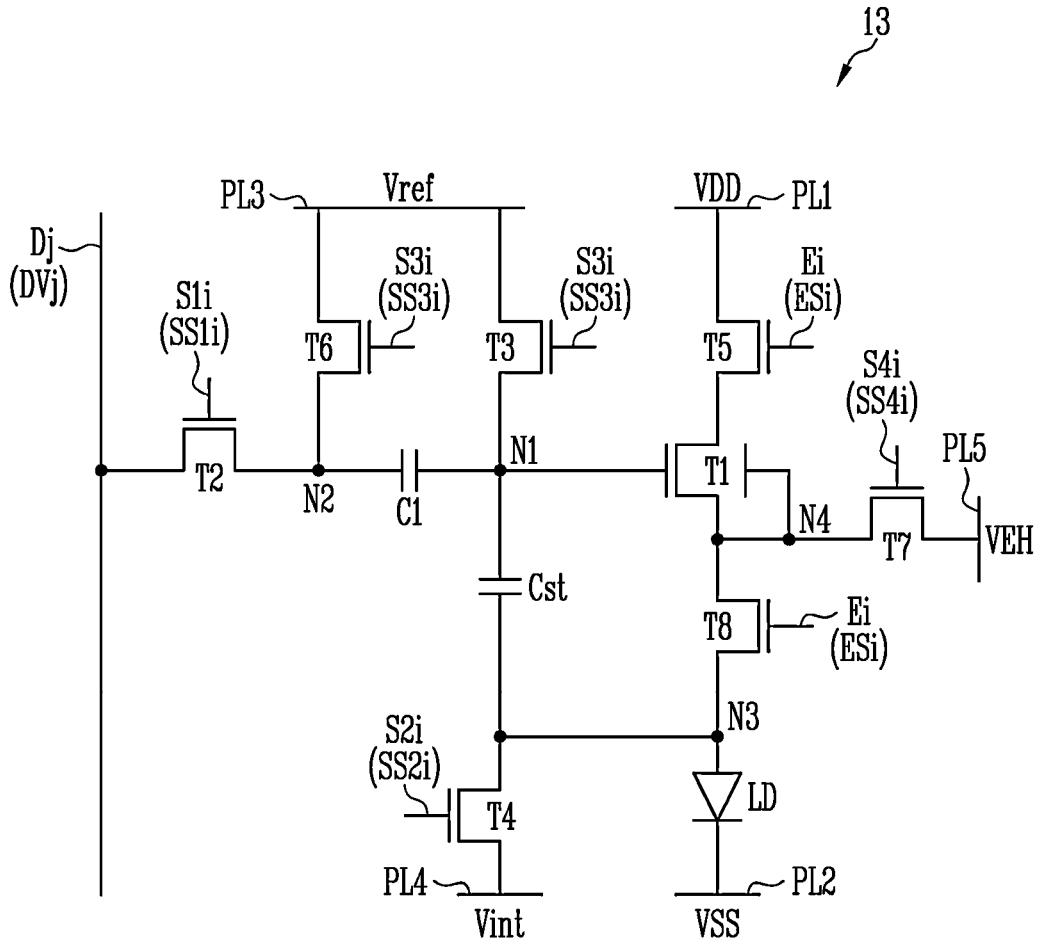
FIG. 8 is a circuit diagram illustrating an embodiment of a pixel included in the display device of FIG. 7.
Figure 9:
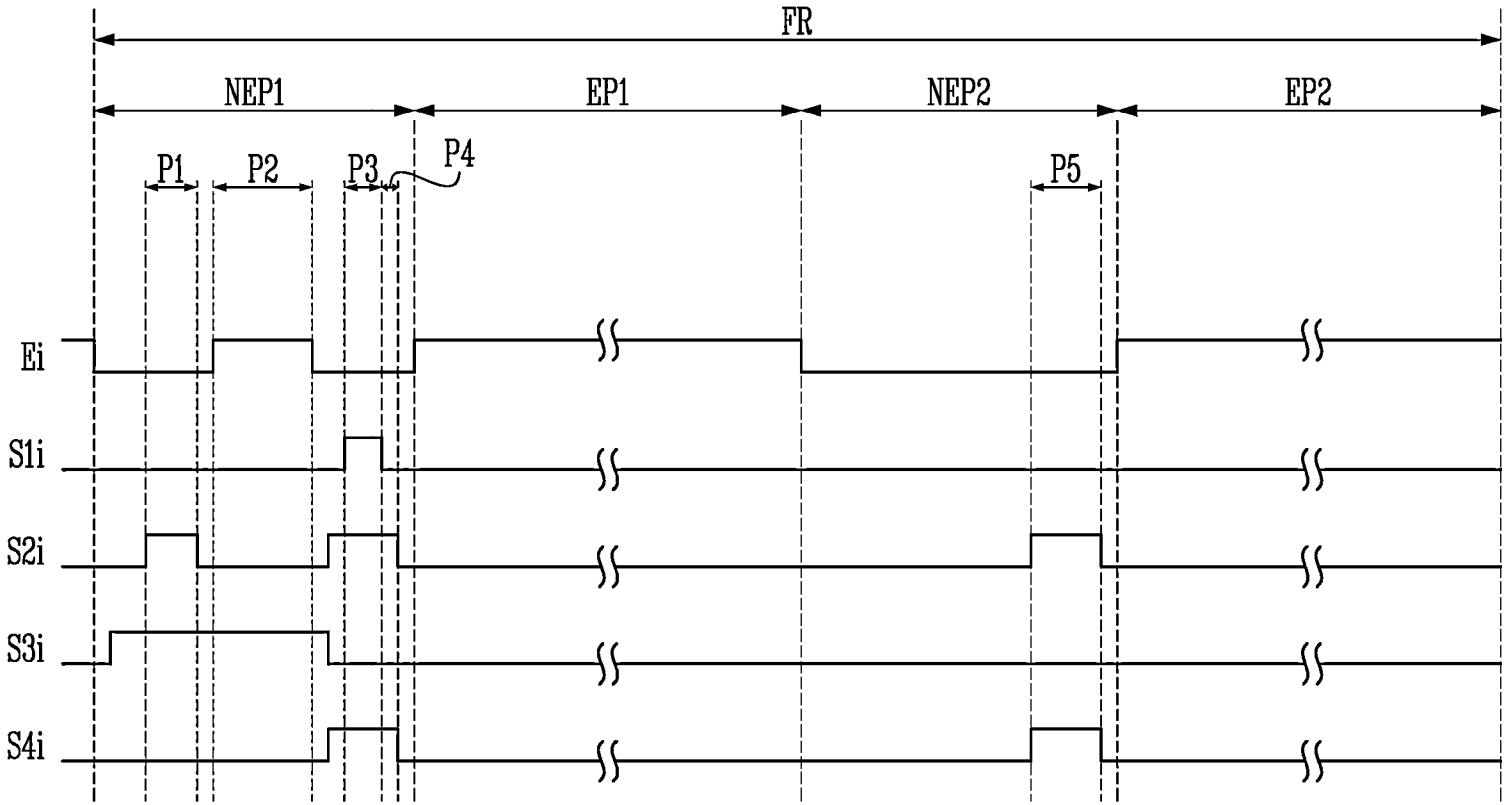
FIG. 9 is a timing diagram illustrating an embodiment of signals supplied to the pixel of FIG. 8.

FIG. 8 is a circuit diagram illustrating an embodiment of a pixel included in the display device of FIG. 7, and FIG. 9 is a timing diagram illustrating an embodiment of signals supplied to the pixel of FIG. 8.

In the following description of FIGS. 8 and 9, the same reference numerals are used to designate the same or similar components as those of FIGS. 2 and 4, and repetitive description thereof will be omitted.

Referring to FIGS. 8 and 9, the pixel 13 may include a light-emitting element LD, first to eighth transistors T1 to T8, a storage capacitor Cst, and a first capacitor C1.

The seventh transistor T7 may be connected between the first electrode (e.g. the source electrode, the fourth node N4) of the first transistor T1 and the fifth power line PL5. The fifth supply voltage VEH (e.g., bias voltage) may be supplied to the fifth power line PL5. In an embodiment, the fifth supply voltage VEH may be about −3V to about 3V, for example.

The gate electrode of the seventh transistor T7 may be connected to an i-th fourth scan line S4*i* (hereinafter, also referred to as a fourth scan line). When the fourth scan signal is supplied to the fourth scan line S4*i*, the seventh transistor T7 may be turned on to supply the fifth supply voltage VEH to the source electrode and the second gate electrode (back gate electrode) of the first transistor T1.

When the fifth supply voltage VEH is supplied to the source electrode (the fourth node N4) of the first transistor T1, the bias state of the first transistor T1 may be changed, and the threshold voltage characteristics of the first transistor T1 may be changed. Consequently, in low-frequency driving, the characteristics of the first transistor T1 may be fixed to a predetermined state to be prevented from being deteriorated.

The eighth transistor T8 may be connected between the fourth node N4 and the third node N3. The gate electrode of the eighth transistor T8 may be connected to the emission control line Ei. The eighth transistor T8 may be turned off in response to the emission control signal ESi. Therefore, a voltage change in the storage capacitor Cst due to the fifth supply voltage VEH supplied to the fourth node N4 may be prevented.

As shown in FIG. 9, in an embodiment, the fourth scan driver 800 may supply the fourth scan signal to the fourth scan line S4*i* in the third period P3, the fourth period P4, and the fifth period P5. Therefore, the fifth supply voltage VEH may be supplied to the source electrode of the first transistor T1 in the third period P3, the fourth period P4, and the fifth period P5.

However, this is merely illustrative. In the first non-emission period NEP1, the fourth scan signal may be supplied in the fourth period P4 or after the fourth period P4. Further, in the second non-emission period NEP2, the fourth scan signal may be supplied in periods other than the fifth period P5 or in a part of the fifth period P5.

By periodically supplying the fifth supply voltage VEH to the source electrode of the first transistor T1 in low-frequency driving, the characteristics of the first transistor T1 may be fixed to a predetermined state to be prevented from being deteriorated. Therefore, the image quality may be further improved in the low-frequency driving.

Although the invention has been described with reference to preferred embodiments, it is to be understood that changes and variations may be made without departing from the spirit or scope of the following claims.

A pixel applied to variable frequency driving including low frequency driving and a display device including the pixel in embodiments of the invention may include a first capacitor and a sixth transistor. Therefore, a data signal is provided to a first transistor according to a capacitance ratio of the first capacitor and the storage capacitor connected in series with each other, so a data swing range for expressing an entire grayscale may be reduced, and thereby power consumption may be reduced, and an area (and capacitance) of the storage capacitor may be greatly increased. Therefore, compensation for a voltage drop by a second power line may be enhanced without an increase in power consumption, so that image quality may be improved.

Furthermore, a threshold voltage compensation period (second period) and a data writing period (third period) are separated from each other, and the data writing period has a time of two or more horizontal cycles that partially overlap with the data writing periods of adjacent pixel rows, so that threshold voltage compensation time and data writing time may be sufficiently secured. Therefore, the image quality of high resolution panel driving, large panel driving, and/or high frequency driving of about 120 Hz or higher may be improved.

However, effects of the invention are not limited to the above-described effects, and various modifications are possible without departing from the spirit and scope of the invention.

What is claimed is:

1. A display device comprising:

first to third scan lines;

an emission control line;

a data line;

a scan driver which supplies a first scan signal, a second scan signal, and a third scan signal to the first scan line, the second scan line, and the third scan line, respectively, in a first non-emission period, and supplies the second scan signal to the second scan line in a second non-emission period;

an emission driver which supplies an emission control signal to the emission control line in the first non-emission period and the second non-emission period;

a data driver which supplies a data signal to the data line in the first non-emission period; and a pixel connected to the first to third scan lines, the emission control line and the data line and comprising:

a light-emitting element;

a first transistor which controls a driving current which flows from a first power line which provides a first supply voltage through the light-emitting element to a second power line which provides a second supply voltage based on a voltage of a first node;

a second transistor which is connected between the data line and a second node, and turned on in response to the first scan signal supplied to the first scan line;

a first capacitor connected between the first node and the second node;

a third transistor which is connected between a third power line which provides a third supply voltage and the first node, and turned on in response to the third scan signal supplied to the third scan line;

a storage capacitor connected between the first node and a third node;

a fourth transistor which is connected between the third node and a fourth power line which provides a fourth supply voltage, and turned on in response to the second scan signal supplied to the second scan line;

a fifth transistor which is connected between the first power line and the first transistor, and turned off in response to the emission control signal supplied to the emission control line; and a sixth transistor which supplies a fifth supply voltage to the second node in response to the third scan signal, wherein:

the sixth transistor is connected between the third power line and the second node, and the fifth supply voltage is the third supply voltage.

2. The display device according to claim 1, wherein the first transistor comprises:

a first electrode connected to the fifth transistor;

a second electrode electrically connected to the third node;

a first gate electrode connected to the first node; and a second gate electrode connected to the second electrode.

3. The display device according to claim 2, wherein capacitance of the storage capacitor is greater than capacitance of the first capacitor.

4. The display device according to claim 1, wherein at least one of the second to sixth transistors comprises:

an oxide semiconductor pattern;

a first gate electrode overlapping the oxide semiconductor pattern; and a second gate electrode facing the first gate electrode with the oxide semiconductor pattern interposed therebetween, and electrically connected to the first gate electrode.

5. The display device according to claim 1, wherein:

the first non-emission period comprises a first period, a second period, a third period, and a fourth period which are sequentially performed, and the second scan signal and the third scan signal are supplied to the second scan line and the third scan line, respectively, during the first period.

6. The display device according to claim 1, wherein, during the second period, the third scan signal is supplied to the third scan line, and the fifth transistor is turned on by interruption of the emission control signal.

7. The display device according to claim 6, wherein:

the first scan signal and the second scan signal are supplied to the first scan line and the second scan line, respectively, during the third period, and the data signal is supplied to the pixel in response to the first scan signal.

8. The display device according to claim 7, wherein the second scan signal is supplied to the second scan line during the fourth period.

9. The display device according to claim 1, wherein:

the sixth transistor is connected between a fifth power line and the second node, and the fifth supply voltage is different from the third supply voltage.

10. A display device comprising:

first to third scan lines;

an emission control line;

a data line;

a scan driver which supplies a first scan signal, a second scan signal, and a third scan signal to the first scan line, the second scan line, and the third scan line, respectively, in a first non-emission period, and supplies the second scan signal to the second scan line in a second non-emission period;

an emission driver which supplies an emission control signal to the emission control line in the first non-emission period and the second non-emission period;

a data driver which supplies a data signal to the data line in the first non-emission period; and a pixel connected to the first to third scan lines, the emission control line and the data line and comprising:
a light-emitting element;
a first transistor which controls a driving current which flows from a first power line which provides a first supply voltage through the light-emitting element to a second power line which provides a second supply voltage based on a voltage of a first node;
a second transistor which is connected between the data line and a second node, and turned on in response to the first scan signal supplied to the first scan line;
a first capacitor connected between the first node and the second node;
a third transistor which is connected between a third power line which provides a third supply voltage and the first node, and turned on in response to the third scan signal supplied to the third scan line;
a storage capacitor connected between the first node and a third node;
a fourth transistor which is connected between the third node and a fourth power line which provides a fourth supply voltage, and turned on in response to the second scan signal supplied to the second scan line;
a fifth transistor which is connected between the first power line and the first transistor, and turned off in response to the emission control signal supplied to the emission control line; and
a sixth transistor which supplies a fifth supply voltage to the second node in response to the third scan signal,
wherein:
the sixth transistor is connected between the first node and the second node, and
the fifth supply voltage is identical to the third supply voltage.

11. A display device comprising:
first to third scan lines;
an emission control line;
a data line;
a scan driver which supplies a first scan signal, a second scan signal, and a third scan signal to the first scan line, the second scan line, and the third scan line, respectively, in a first non-emission period, and supplies the second scan signal to the second scan line in a second non-emission period;
an emission driver which supplies an emission control signal to the emission control line in the first non-emission period and the second non-emission period;
a data driver which supplies a data signal to the data line in the first non-emission period; and
a pixel connected to the first to third scan lines, the emission control line and the data line and comprising:
a light-emitting element;
a first transistor which controls a driving current which flows from a first power line which provides a first supply voltage through the light-emitting element to a second power line which provides a second supply voltage based on a voltage of a first node;
a second transistor which is connected between the data line and a second node, and turned on in response to the first scan signal supplied to the first scan line;
a first capacitor connected between the first node and the second node;
a third transistor which is connected between a third power line which provides a third supply voltage and the first node, and turned on in response to the third scan signal supplied to the third scan line;
a storage capacitor connected between the first node and a third node;
a fourth transistor which is connected between the third node and a fourth power line which provides a fourth supply voltage, and turned on in response to the second scan signal supplied to the second scan line;
a fifth transistor which is connected between the first power line and the first transistor, and turned off in response to the emission control signal supplied to the emission control line; and
a sixth transistor which supplies a fifth supply voltage to the second node in response to the third scan signal,
wherein:
the first non-emission period comprises a first period, a second period, a third period, and a fourth period which are sequentially performed, and
the second scan signal and the third scan signal are supplied to the second scan line and the third scan line, respectively, during the first period,
wherein the display device further comprising a fourth scan line and a fifth power line,
wherein the scan driver supplies a fourth scan signal to the pixel through the fourth scan line in the first non-emission period and the second non-emission period, and
wherein the pixel further comprises:
a seventh transistor which is connected between the fifth power line which provides a sixth supply voltage and the first transistor, and turned on in response to the fourth scan signal; and
an eighth transistor which is connected between the first transistor and the third node, and turned off in response to the emission control signal.

12. The display device according to claim 11, wherein the scan driver supplies the fourth scan signal to the fourth scan line in the fourth period.

13. The display device according to claim 12, wherein the fourth scan signal overlaps at least a part of the third period.

14. A pixel connected to first to fifth power lines, first to third scan lines, a data line and an emission control line, the pixel comprising:
a light-emitting element;
a first transistor which controls a driving current which flows from the first power line which provides a first supply voltage through the light-emitting element to the second power line which provides a second supply voltage based on a voltage of a first node;
a second transistor which is connected between the data line and a second node, and turned on in response to a first scan signal supplied to the first scan line;
a first capacitor connected between the first node and the second node;
a third transistor which is connected between the third power line which provides a third supply voltage and the first node, and turned on in response to a third scan signal supplied to the third scan line;
a storage capacitor connected between the first node and a third node;
a fourth transistor which is connected between the third node and the fourth power line which provides a fourth supply voltage, and turned on in response to a second scan signal supplied to the second scan line;
a fifth transistor which is connected between the first power line and the first transistor, and turned off in response to an emission control signal supplied to the emission control line; and a sixth transistor connected between the fifth power line and the second node, the fifth power line which provides a fifth supply voltage in response to the third scan signal, wherein:

the sixth transistor is connected between the third power line and the second node, and the fifth supply voltage is the third supply voltage.

15. The pixel according to claim 14, wherein the first transistor comprises:

a first electrode connected to the fifth transistor;

a second electrode electrically connected to the third node;

a first gate electrode connected to the first node; and a second gate electrode connected to the second electrode, and capacitance of the storage capacitor is greater than capacitance of the first capacitor.

16. The pixel according to claim 15, wherein:

one frame period comprises a first non-emission period and at least one second non-emission period, the first non-emission period comprises a first period, a second period, a third period, and a fourth period which are sequentially performed, and the third transistor, the fourth transistor, and the sixth transistor are turned on during the first period.

17. The pixel according to claim 16, wherein, during the second period, the third transistor, the fifth transistor, and the sixth transistor are turned on, and a threshold voltage of the first transistor is stored in the storage capacitor.

18. The pixel according to claim 17, wherein:

during the third period, the second transistor and the fourth transistor are turned on, and a data signal is written, and the fourth transistor is turned on during the fourth period.

* * * * *